US011662168B2

(12) United States Patent
Borchert

(10) Patent No.: US 11,662,168 B2
(45) Date of Patent: May 30, 2023

(54) BREECH BLOCK AND GUN

(71) Applicant: Rheinmetall Waffe Munition GmbH, Suedheide (DE)

(72) Inventor: Ruediger Borchert, Hermannsburg (DE)

(73) Assignee: Rheinmetall Waffe Munition GmbH, Suedheide (DE)

( * ) Notice: Subject to any disclaimer, the term of this patent is extended or adjusted under 35 U.S.C. 154(b) by 0 days.

(21) Appl. No.: 17/675,111

(22) Filed: Feb. 18, 2022

(65) Prior Publication Data

US 2022/0170709 A1 Jun. 2, 2022

Related U.S. Application Data

(63) Continuation of application No. PCT/EP2020/070781, filed on Jul. 23, 2020.

(30) Foreign Application Priority Data

Aug. 20, 2019 (DE) ..... 10 2019 122 296.6

(51) Int. Cl.
*F41A 15/10* (2006.01)

(52) U.S. Cl.
CPC ..... *F41A 15/10* (2013.01)

(58) Field of Classification Search
CPC ..... F41A 15/08; F41A 15/10
USPC ..... 42/25
See application file for complete search history.

(56) References Cited

U.S. PATENT DOCUMENTS 2,870,680 A 1/1959 Correc
4,648,190 A * 3/1987 Allen ..... F41A 17/58 42/23
4,879,827 A * 11/1989 Gentry ..... F41A 15/10 42/23
5,307,724 A 5/1994 Breuer et al.
5,673,505 A * 10/1997 Phillips ..... F41A 3/10 42/23

(Continued)

FOREIGN PATENT DOCUMENTS

DE 4133618 C2 2/1997
DE 19843294 C2 10/2001

(Continued)

OTHER PUBLICATIONS

International Search Report dated Oct. 30, 2020 in corresponding application PCT/EP2020/070781.

(Continued)

*Primary Examiner* — Bret Hayes
(74) *Attorney, Agent, or Firm* — Muncy, Geissler, Olds & Lowe, P.C.

(57) ABSTRACT

A breech block, in particular wedge breech block, having a breech end and a breech wedge. The breech block includes an opener shaft with a rotationally coupled opening lever and an ejector system for pulling out cartridge cases or cartridge bases from the breech block. The ejector system includes at least one ejector and at least one ejector lever. The ejector lever is rotationally movably mounted on the opener shaft and the ejector system has at least one transmission element which transmits a rotational movement of the opening lever to the ejector lever.

9 Claims, 5 Drawing Sheets

(56) References Cited

U.S. PATENT DOCUMENTS

| | | | | |
|---|---|---|---|---|
| 6,233,860 | B1 * | 5/2001 | Hazen | F41A 17/66 42/23 |
| 6,260,297 | B1 | 7/2001 | Schmees | |
| 2002/0133997 | A1 * | 9/2002 | Kepner | F41A 15/10 42/23 |
| 2009/0100733 | A1 * | 4/2009 | Zumalde | F41A 3/10 42/23 |

FOREIGN PATENT DOCUMENTS

| | | | |
|---|---|---|---|
| DE | 102004052550 | A1 | 5/2006 |
| GB | 639187 | A | 6/1950 |
| GB | 790879 | A | 2/1958 |

OTHER PUBLICATIONS

Written Opinion of the International Searching Authority dated Oct. 30, 2020 in corresponding application PCT/EP2020/070781.

* cited by examiner

BREECH BLOCK AND GUN

This nonprovisional application is a continuation of International Application No. PCT/EP2020/070781, which was filed on Jul. 23, 2020, and which claims priority to German Patent Application No. 10 2019 122 296.6, which was filed in Germany on Aug. 20, 2019, and which are both herein incorporated by reference.

BACKGROUND OF THE INVENTION

Field of the Invention

The present invention relates to a breech block, preferably a gun barrel breech, in particular wedge breech block, having a breech end and a breech wedge, preferably for a large-caliber gun, comprising an opener shaft with a rotationally coupled opening lever and an ejector system for pulling out cartridge cases or cartridge bases from the breech block, said ejector system comprising at least one ejector and at least one ejector lever, which actuates the ejector.

Furthermore, the invention relates to a gun having such a breech block.

Description of the Background Art

DE 10 2004 052 550 A1, which is incorporated herein by reference, discloses a wedge breech block for a gun. The wedge breech block has a breech wedge that can be opened downwards perpendicular to the bore axis of the gun barrel.

DE 198 43 294 C2, which corresponds to U.S. Pat. No. 6,260,297, which is incorporated herein by reference, discloses a large-caliber firearm having a gun barrel and a breech end attached to it on the breech side. Attached to the breech end is a catch and ejection device for fixing and pulling out rimless cartridge cases which is longitudinally movably arranged and has an ejector which is pivotable against the pressure of a compression spring.

DE 41 33 618 C2, which corresponds to U.S. Pat. No. 5,307,724, which is incorporated herein by reference, shows an ejector system for barrel weapons that has a linearly slidable ejector that is operated via an ejector lever. The ejector lever is in turn operated via a control cam arranged on the breech wedge.

SUMMARY OF THE INVENTION

It is therefore an object of the present invention to provide a breech block that has an improved ejector system.

According to an example of the invention, a breech block, in particular wedge breech block, having a breech end and a breech wedge is provided, comprising an opener shaft with a rotationally coupled opening lever and an ejector system for pulling out cartridge cases or cartridge bases from the breech block, said ejector system comprising at least one ejector and at least one ejector lever, which actuates the ejector, wherein the ejector lever is rotationally movably mounted on the opener shaft and the ejector system comprises at least one transmission element that transmits a rotational movement of the opening lever to the ejector lever.

Further, according to the invention, a gun is provided which comprises at least one such breech block or one further developed as described below.

The gun is a barrel gun with a recoiling mass, which comprises at least one gun barrel and the breech block.

The wedge breech block is in particular a vertical wedge breech block having a breech wedge that is movable transversely to the bore axis of the gun barrel between a closed and an open position.

Furthermore, the breech block comprises a breech block mechanism by means of which the breech block can be opened and closed.

The opener shaft and the opening lever which is rotationally coupled to the opener shaft are used to move the breech wedge between an open and a closed position. The opener shaft is driven by the breech block mechanism.

The at least one ejector lever is rotationally mounted on the opener shaft. A rotational movement of the opener shaft is not transmitted directly to the ejector lever, but instead the rotational movement of the opener shaft is transmitted to the ejector lever via the transmission element.

The ejector lever operates the ejector, which in turn ejects the cartridge case or the cartridge base.

According to the invention, a breech block with a small ejector system is created, which makes it possible that a direct contact between opening lever and ejector lever is avoided. According to the invention, the rotational movement of the opening lever is first transmitted to the transmission element, which in turn transmits the rotational movement to the ejector lever. This prevents a direct impact or shock-like actuation of the ejector lever by the opening lever. As a result, less wear of the opening lever and ejector lever is ensured and thus an improved service life is achieved.

The transmission element can be mounted on a first axis, which is spaced from the opener shaft.

This ensures that the rotational movement of the opening lever does not have to be transmitted directly to the ejector lever, but instead that the transmission element is arranged as an intermediate element between the ejector lever and the opening lever and can transmit or reduce the rotational movement of the opening lever to the ejector lever.

Another advantage is that the transmission element can be changed independently of the opener shaft and the ejector lever due to the bearing on the first axis and a simple assembly or disassembly of the transmission element is guaranteed.

The ejector system can have at least one first contact roller arranged at the end of the transmission element for contact with the opening lever and at least has a second contact roller arranged at the first end of the transmission element for contact with the at least one ejector lever.

This ensures that an unrolling takes place between the contact rollers of the transmission element and the respective lever that is contacted. Friction losses between the opening lever and the first contact roller, as well as between the ejector lever and the second contact roller are thus avoided. This leads to a lower wear and an increased service life of the ejector system of the breech block according to the invention.

A first contact roller per opening lever and a second contact roller per ejector lever can be formed.

The at least one first contact roller and at least one second contact roller can be arranged on a common second axis.

The ejector system can have at least one preload element that the transmission element preloads against the at least one ejector lever.

As a result, the transmission element and ejector lever are in contact with each other at all times, thus also with the case base. When an ejector movement initiates and the ejectors are actuated, these are already in contact with the cartridge case base that is to be ejected.

The preload element can be designed, for example, as a spring, or as a spring damper system.

The at least one ejector lever can have a lever arm with an arc-shaped contact surface, which is permanently in contact with the at least one second contact roller.

This achieves that the rotational movement of the opening lever is not transmitted linearly to the ejector lever, but instead that the angle of rotation of the rotational movement of the ejection lever describes a degressive or a progressive characteristic curve in relation to the angle of rotation of the rotational movement of the opening lever. Accordingly, the ejector describes a corresponding degressive or progressive characteristic curve with regard to the forward movement. Thus, the shape of the arc-shaped contact surface can predetermine the movement characteristics of the ejector. The movement characteristics of the ejector can also be adjusted by changing the ejector lever.

Thus, the contact changes in the direction of the ejector/the opener shaft axis. If the angular velocity of the opening lever remains the same, the transmission behavior changes.

Furthermore, it may be provided that the contact surface can be essentially concave, so that when opening the breech block, the rotation angle of the rotational movement of the ejector lever in relation to the rotation angle of the rotational movement of the opening lever describes a progressive characteristic curve.

The progressive characteristic curve ensures that a cartridge base or cartridge to be ejected is continuously accelerated throughout the ejection process, so that a safe ejection of the cartridge or the cartridge base is ensured.

The opening lever can be formed in such a way that it is not in contact with the first contact roller in the open position of the breech block and the first contact roller can be brought into contact with the opening lever in the course of the opening process.

This ensures that there is no permanent contact between the opening lever and the ejector lever, so that a preload between these elements is avoided. This prevents the preload elements of the ejector system from wearing out.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
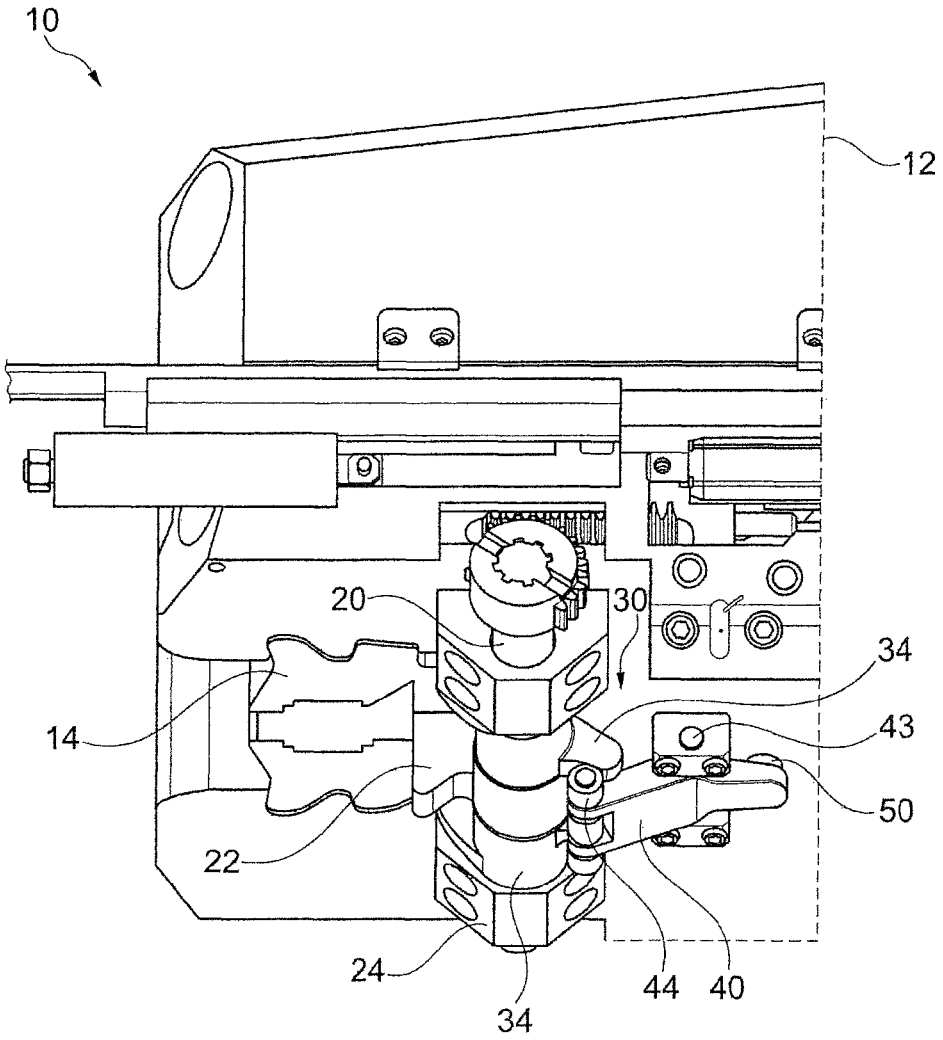
FIG. 1 is a schematic perspective view of the inventive breech block having an ejector system.

FIG. 1 shows a schematic perspective view of the breech block 10 according to the invention having an ejector system 30. The breech block 10 is preferably a gun barrel breech, in particular a wedge breech block having a breech end 12 and a breech wedge 14.

The breech block is part of a gun (not shown).

The breech block 10 also has an opener shaft 20 with a rotationally coupled opening lever 22. The opener shaft 20 is mounted at the bottom of the breech end 12 by means of several opener shaft bearings 24.

Furthermore, the opener shaft 20 has a cog wheel, via which the opener shaft 20 can be driven.

The breech block 10 also has an ejector system 30 for pulling out cartridge cases or cartridge bases from the breech block 10. The ejector system 30 comprises at least one ejector 32 and at least one ejector lever 34, which actuates the ejector 32.

The ejector lever 34 is rotationally movably mounted on the opener shaft 22 and the ejector system has at least one transmission element 40, which transmits a rotational movement of the opening lever 22 to the ejector lever 34.

Figure 2:
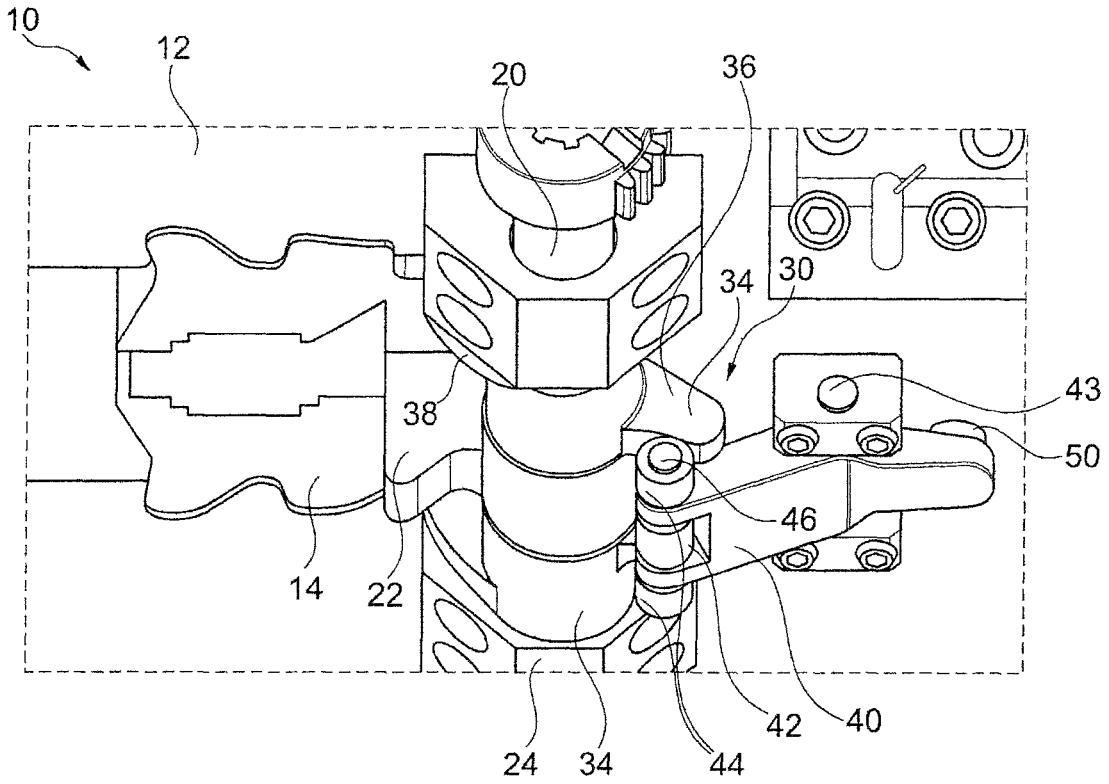
FIG. 2 is a schematic perspective enlarged view of the breech block having the ejector system from FIG. 1.

FIG. 2 shows a schematic perspective enlarged view of the breech block having the ejector system 30 from FIG. 1. As can be seen more clearly from FIG. 2, the transmission element 40 is mounted on a first axis 43, which is spaced from the opener shaft 20. The first axis 43 is attached to the underside of the breech end 12 with appropriate bearings, which support the axis 43.

At one end 41*a* of the transmission element 40 at least a first contact roller 42 is arranged for contact with the opening lever 22. Furthermore, at least a second contact roller 44 for contact with the at least one ejector lever 34 is arranged at the first end 41*a* of the transmission element 40.

The at least one first contact roll 42 and the at least one second contact roll 44 are arranged on a common second axis 46.

The ejector system 30 has at least one preload element 50 that the transmission element 40 preloads against the at least one ejector lever 34. According to the embodiment, the preload element 50 is a spring arranged at a second end 41*b* of the transmission element 40.

Figure 3A:
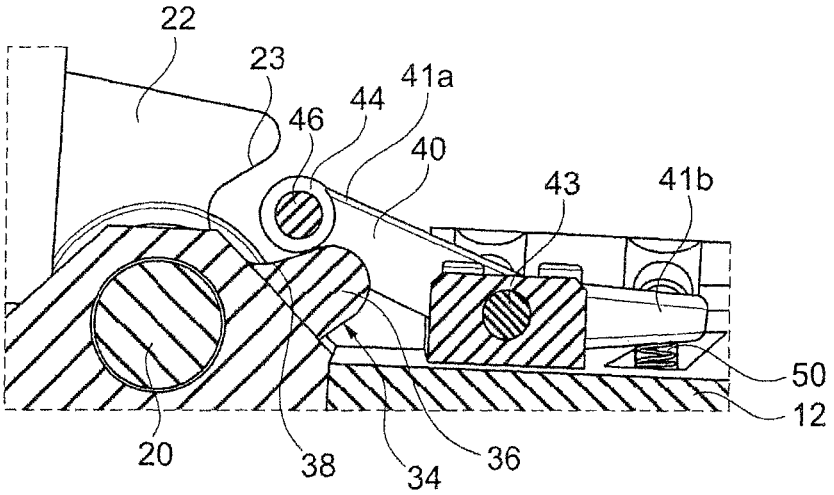
FIG. 3*a* is a schematic side view of the ejector system of the inventive breech block, wherein the breech wedge is in a closed position.

As shown in FIG. 1 and FIG. 2, the transmission element 40 is embodied as a lever. As can be seen in FIG. 3*a*, the first end 41*a* has two fork-like protrusions on which the axis 46 is arranged. The second end 41*b* is arranged on the opposite side of the transmission element 40 and angled to the first end 41*a*.

In FIG. 1 and FIG. 2 it can be seen that two ejector levers 34 are formed, for each of which a second contact roller 34 is formed.

Figure 3B:
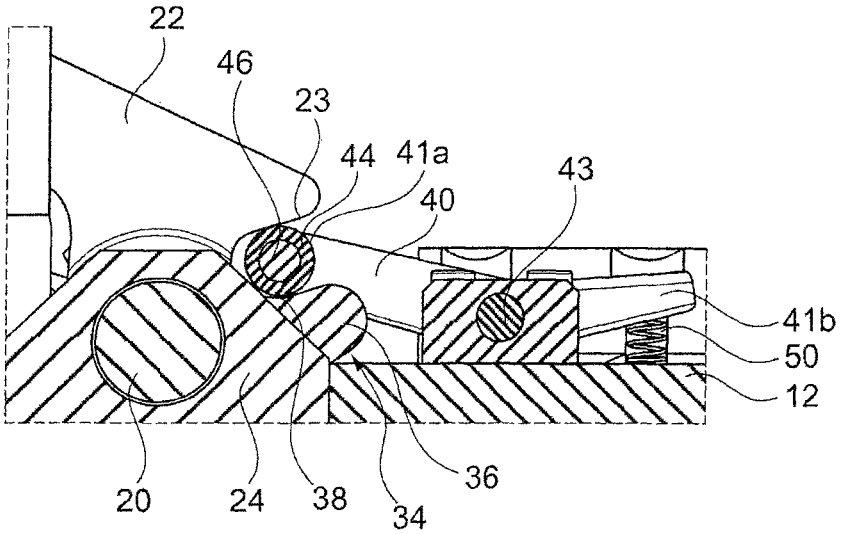
FIG. 3*b* is a schematic side view of the ejector system of the inventive breech block according to FIG. 3*a*, wherein the breech wedge is in the open position.

FIG. 3*a* shows a schematic side view of the ejector system 30 of the inventive breech block 10, wherein the breech wedge 14 is in a closed position. FIG. 3*b* shows a schematic side view of the ejector system 30 of the inventive breech block 10 according to FIG. 3*a*, wherein the breech wedge 14 is in the open position.

The at least one ejector lever 34 has a first lever arm 36 with an arc-shaped contact surface 38, which is permanently in contact with the at least one second contact roller 44.

Furthermore, the ejector lever 34 has a second lever arm 38, as can be seen in FIG. 1. The second lever arm 38 is used to operate the ejector 32.

The contact surface 38 of the first lever arm 36 is essentially concave, so that when opening the breech block 10, the rotation angle of the rotational movement of the ejector lever 34 in relation to the rotation angle of the rotational movement of the opening lever 22 describes a progressive characteristic curve.

The opening lever 22 is designed in such a way that it is not in contact with the first contact roller 42 in the open position of the breech block 10 and the first contact roller 42 can be brought into contact with the opening lever 22 in the course of the opening process.

As can be seen in FIG. 3*a* and FIG. 3*b*, the opening lever 22 has a protrusion with a contact surface 23 which can be brought into contact with the first contact roller 42. The contact surface 23 of the opening lever 22 is essentially flat.

Figure 4:
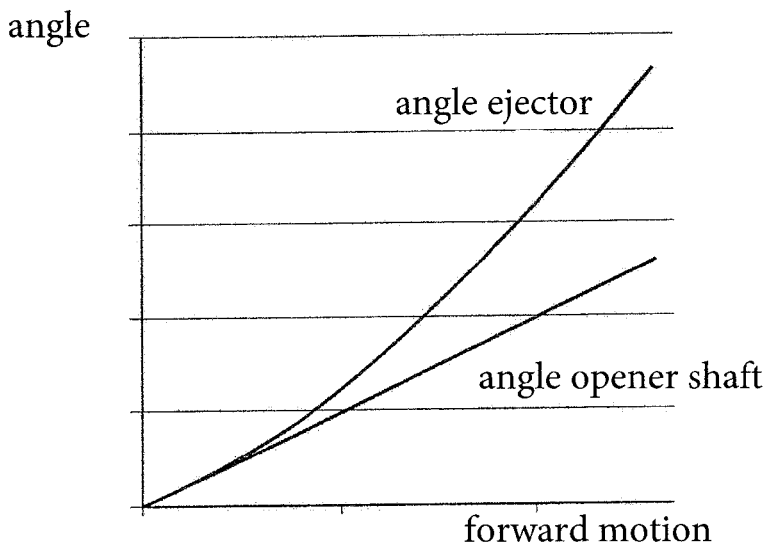
FIG. 4 is a schematic diagram of the angle of the opening lever and the angle of the ejector lever in relation to the forward movement.

FIG. 4 shows a schematic diagram of the rotation angle of the opening lever 22 and the rotation angle of the ejector lever 34 in relation to the forward movement. The diagram shows that in relation to the forward movement, the angle of rotation of the opener shaft 20 changes linearly and the angle of rotation of the ejector 32 describes a progressive characteristic curve.

Figure 5:
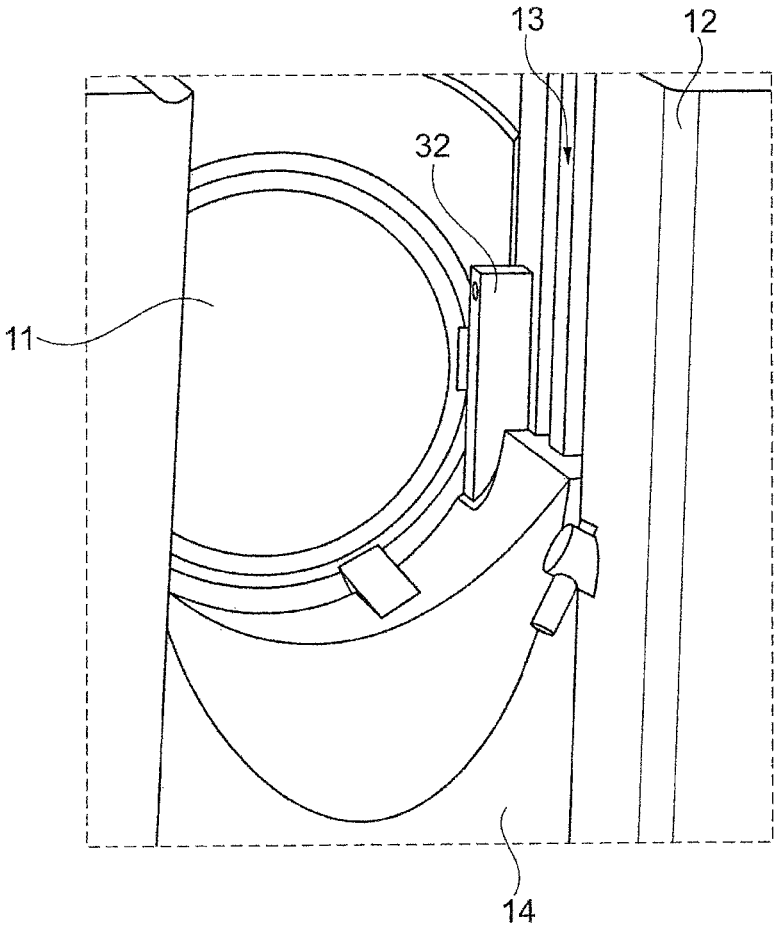
FIG. 5 is a schematic rear view of the breech block.

FIG. 5 shows a schematic rear view of the breech block 10 according to the invention in an open position with open cartridge bearing 11. The breech wedge 14 is in the open position and the ejector 32 is clearly visible. The view shown in FIG. 5 shows the ejector 32 after ejection of a cartridge base or a cartridge case.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A breech block comprising:

a breech end;

a breech wedge;

an opener shaft with a rotationally coupled opening lever; and an ejector system to pull out cartridge cases or cartridge bases out of the breech block, the ejector system comprising:

at least one ejector;

at least one ejector lever, the at least one ejector lever being rotationally movably mounted on the opener shaft; and at least one transmission element that is designed to transmit a rotational movement of the opening lever to the at least one ejector lever, wherein the opener shaft, the opening lever and the at least one ejector lever have a same axis of rotation, and wherein the at least one transmission element is mounted on a first axis which is spaced from the opener shaft.

2. The breech block according to claim 1, wherein the ejector system has at least one preload element that the at least one transmission element preloads against the at least one ejector lever.

3. A gun comprising at least one breech block according to claim 1.

4. The breech block according to claim 1, wherein the at least one transmission element is a lever having a first end and a second end, wherein the second end of the lever is angled with respect to the first end.

5. A breech block comprising:

a breech end;

a breech wedge;

an opener shaft with a rotationally coupled opening lever; and an ejector system to pull out cartridge cases or cartridge bases out of the breech block, the ejector system comprising:

at least one ejector;

at least one ejector lever, the at least one ejector lever being rotationally movably mounted on the opener shaft; and at least one transmission element that is designed to transmit a rotational movement of the opening lever to the at least one ejector lever, wherein the ejector system has at least one first contact roller arranged at a first end of the at least one transmission element for contact with the opening lever and has at least one second contact roller arranged at the first end of the transmission element for contact with the at least one ejector lever.

6. The breech block according to claim 5, wherein the at least one first contact roller and the at least one second contact roller are arranged on a common axis.

7. The breech block according to claim 5, wherein the at least one ejector lever has a lever arm with an arc-shaped contact surface that is permanently in contact with the at least one second contact roller.

8. The breech block according to claim 7, wherein the arc-shaped contact surface is substantially concave, so that when opening the breech block, a rotation angle of a rotational movement of the at least one ejector lever in relation to an angle of rotation of a rotational movement of the opening lever describes a progressive characteristic curve.

9. The breech block according to claim 5, wherein the opening lever is not in contact with the at least one first contact roller in a closed position of the breech block and the at least one first contact roller is brought into contact with the opening lever in the course of an opening process to place the breech block in an open position.

* * * * *